US009142362B2

(12) United States Patent
Huang et al.

(10) Patent No.: US 9,142,362 B2
(45) Date of Patent: Sep. 22, 2015

(54) FABRIC PRESSURE SWITCH

(71) Applicant: KING'S METAL FIBER TECHNOLOGIES CO., LTD., Taichung (TW)

(72) Inventors: Hong-Hsu Huang, Taipei (TW); I-Chen Su, Taipei (TW); King-Mu Hsiao, Taipei (TW); Shun-Tung Yang, Taipei (TW)

(73) Assignee: King's Metal Fiber Technologies Co., Ltd., Taichung (TW)

( * ) Notice: Subject to any disclaimer, the term of this patent is extended or adjusted under 35 U.S.C. 154(b) by 0 days.

(21) Appl. No.: 14/666,465

(22) Filed: Mar. 24, 2015

(65) Prior Publication Data

US 2015/0194274 A1 Jul. 9, 2015

Related U.S. Application Data

(63) Continuation-in-part of application No. 13/781,858, filed on Mar. 1, 2013.

(51) Int. Cl.
*H01H 9/00* (2006.01)
*H01H 1/029* (2006.01)

(52) U.S. Cl.
CPC ..... *H01H 1/029* (2013.01)

(58) Field of Classification Search
CPC ..... D10B 2101/20; D02G 3/04; A41D 1/00; A41D 1/007
USPC ..... 200/61.14, 61.13; 442/59, 60, 61, 228, 442/229; 66/202
See application file for complete search history.

(56) References Cited

U.S. PATENT DOCUMENTS

| | | | | |
|---|---|---|---|---|
| 8,476,172 | B2 * | 7/2013 | Christof | 442/304 |
| 8,669,195 | B2 * | 3/2014 | Swallow et al. | 442/229 |
| 8,966,942 | B2 * | 3/2015 | Dias et al. | 66/170 |
| 2005/0081913 | A1 * | 4/2005 | Ebbesen et al. | 136/291 |
| 2006/0258247 | A1 * | 11/2006 | Tao et al. | 442/301 |
| 2006/0281382 | A1 * | 12/2006 | Karayianni et al. | 442/181 |
| 2011/0047957 | A1 * | 3/2011 | Richard | 57/236 |
| 2012/0144561 | A1 * | 6/2012 | Begriche et al. | 2/243.1 |

* cited by examiner

*Primary Examiner* — Vanessa Girardi
(74) *Attorney, Agent, or Firm* — Rosenberg,Klein & Lee

(57) ABSTRACT

A fabric pressure switch includes a first resilient conductive tissue, a second resilient conductive tissue, and a support tissue. The support tissue is arranged between and connects the first resilient conductive tissue and the second resilient conductive tissue. The first resilient conductive tissue, the second resilient conductive tissue, and the support tissue are unitarily combined through knitting to form the fabric pressure switch.

7 Claims, 4 Drawing Sheets

FABRIC PRESSURE SWITCH

REFERENCE TO RELATED APPLICATION

This Application is being filed as a Continuation-in-Part Application of application Ser. No. 13/781,858, filed 1 Mar. 2013, currently pending.

FIELD OF THE INVENTION

The present invention relates to a fabric pressure switch, and in particular to a fabric pressure switch that features both resiliency and electrical conductivity.

BACKGROUND OF THE INVENTION

As shown in FIG. 1, a conventional detection element 1 for physiological examination comprises a base layer 10 and an electrically conductive layer 11 formed on the base layer 10. To use, the electrically conductive layer is attached to human skin surface to detect a signal generated by the human body. However, the electrically conductive 11 of such a detection element 1 is generally of poor resiliency and has poor electrical conductivity with human skin is poor, making it difficult to detect the signal generated by the human body and also making wear uncomfortable. As shown in FIG. 2, an improvement is made such that a resilient layer 12 is arranged between the electrically conductive layer 11 and the base layer 10 so that contact tightness between the electrically conductive layer 11 and human skin can be improved with the resilient layer 12. Further, a moisture-retaining material is also included in the layer to make the layer also function moisture retaining thereby improving electrical conductivity of the electrically conductive layer 11. However, since the resilient layer 12 and the electrically conductive layer 11 are two separate layers, moisture must penetrate through the electrically conductive layer 11 before being absorbed by the resilient layer 12. Consequently, the absorbability of moisture is affected. When the resilient layer 12 releases water between the electrically conductive layer 11 and human skin, the release of water is also affected by being blocked by the electrically conductive layer 11. Further, since the resilient layer 12 and the electrically conductive layer 11 are two separate layers that are bonded to each other by an external force (such as adhesion). These layers are easily detached from each other due to the high humidity long maintained by the resilient layer 12, making the detection element 1 losing its function. However, said method is to stick the detection element 1 to a garment. When a user wearing the garment, the detection element 1 is probably contact the user's body without pressure to cause the wrong detection.

In view of this problem, the present invention aims to provide a structure that possesses the characteristics of resiliency, electrical conduction, and detection when taking a quantity of pressure in order to achieve the goal of improving electrical conduction and lifespan of product.

SUMMARY OF THE INVENTION

An object of the present invention is to provide a fabric pressure switch that is formed through being unitarily knitted and features resiliency and electrical conductivity.

Another object of the present invention is to provide a fabric pressure switch that features moisture retention.

To realize the above objects, the present invention provides a fabric pressure switch, which comprises a first resilient conductive tissue, which is formed by arranging and interlacing a plurality of first structural yarns, a plurality of second structural yarns, a plurality of first elastic yarns, a plurality of second elastic yarns, and a plurality of first electrically conductive yarns along a first dimension and a second dimension, wherein each of the first structural yarns is combined with each of the first elastic yarns as a first strand, each of the second structural yarns is combined with each of the second elastic yarns as a second strand and a plurality of first stitches are formed by individually interlocking each of the first strand and each of the second strand along the second dimension; a second resilient conductive tissue, which is formed by arranging and interlacing a plurality of third structural yarns, a plurality of fourth structural yarns, a plurality of third elastic yarns, a plurality of fourth elastic yarns, and a plurality of second electrically conductive yarns along the first dimension and the second dimension, wherein each of the third structural yarns is combined with each of the third elastic yarns as a third strand, each of the fourth structural yarns is combined with each of the fourth elastic yarns as a fourth strand, and a plurality of second stitches are formed by individually interlocking each of the third strand and each of the fourth strand along the second dimension; and a support tissue, which is formed of a plurality of first support yarns and a plurality of second support yarns and connects between the first resilient conductive tissue and the second resilient conductive tissue; wherein each of the first support yarns is interlocking with the plurality of first stitches of the first resilient conductive tissue along the second dimension and extends to the second resilient conductive tissue along a third dimension to be interlocked with the plurality of second stitches along the second dimension, a plurality of third stitches are formed by individually interlocking each of the second support yarns with each of the first electrically conductive yarns along the second dimension and each of the second support yarns extends to the second resilient conductive tissue along the third dimension to form a plurality of fourth stitches by individually interlocking each of the second support yarns with each of the second electrically conductive yarns along the second dimension; wherein the plurality of first stitches individually space from the plurality of third stitches along the first dimension, the plurality of second stitches individually space from the plurality of fourth stitches along the first dimension and the first electrically conductive yarns project beyond a surface of the first resilient conductive tissue and the second electrically conductive yarns project beyond a surface of the second resilient conductive tissue; wherein the first resilient conductive tissue and the second resilient conductive tissue extrude the support tissue to contact each other when the fabric pressure switch is taken a pressure and the first resilient conductive tissue and the second resilient conductive tissue are separated by the elasticity of the support tissue and formed a broken circuit when the pressure removes from the fabric pressure switch.

In the above-discussed fabric pressure switch, the first structural yarns, the second structural yarns, the third structural yarns and the fourth structural yarns are each one of polyester yarn, porous fiber yarn, alginate fiber yarn, carboxymethyl cellulose fiber yarn, rayon fiber yarn, metal fiber yarn, carbon nanotube fiber yarn, and carbon fiber yarn.

In the above-discussed fabric pressure switch, the first electrically conductive yarns and the second electrically conductive yarns are one of metal fiber yarn, carbon nanotube fiber yarn, and carbon fiber yarn.

In the above-discussed fabric pressure switch, the first elastic yarns, the second elastic yarns, the third elastic yarns and the fourth elastic yarns are each spandex yarn.

In the above-discussed fabric pressure switch, the first support yarns and the second support yarns are each one of polyester yarn and nylon yarn.

In the above-discussed fabric pressure switch, the first structural yarns, the first elastic yarns, the second structural yarns, the second elastic yarns, and the first electrically conductive yarns are arranged and interlaced through knitting to form the first resilient conductive tissue.

In the above-discussed fabric pressure switch, the third structural yarns, the third elastic yarns, the fourth structural yarns, the fourth elastic yarns, and the second electrically conductive yarns are arranged and interlaced through knitting to form the second resilient conductive tissue.

In the above-discussed fabric pressure switch, the first resilient conductive tissue, the second resilient conductive tissue, and the support tissue are unitarily combined to form the fabric pressure switch, in which the same planar tissue features both resiliency and electrical conductivity and also shows an effect of moisture retention through being combined with structural yarns that feature moisture retention.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
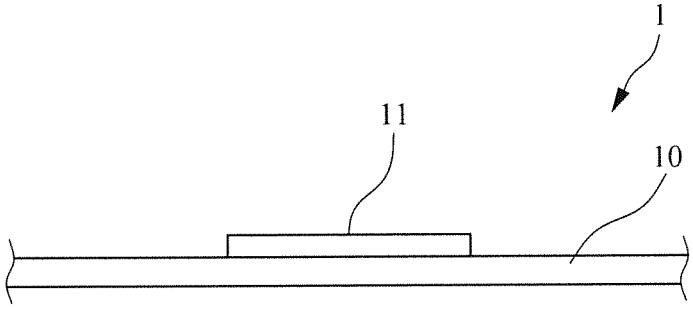
FIG. 1 (Prior Art)
FIG. 1 is a side elevational view showing a conventional detection element for physiological examination.
Figure 2:
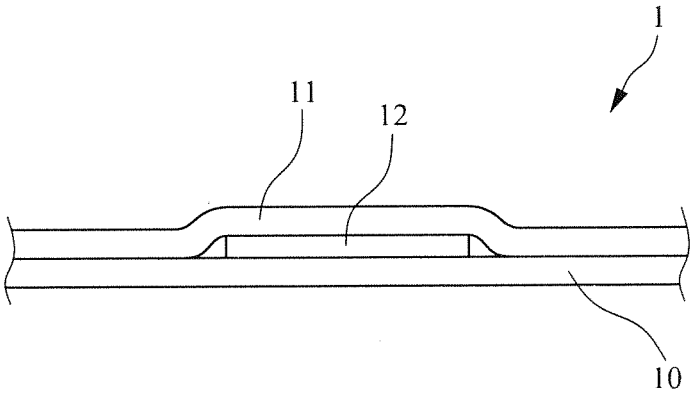
FIG. 2 (Prior Art)
FIG. 2 is a side elevational view showing a conventional detection element for physiological examination.
Figure 3:
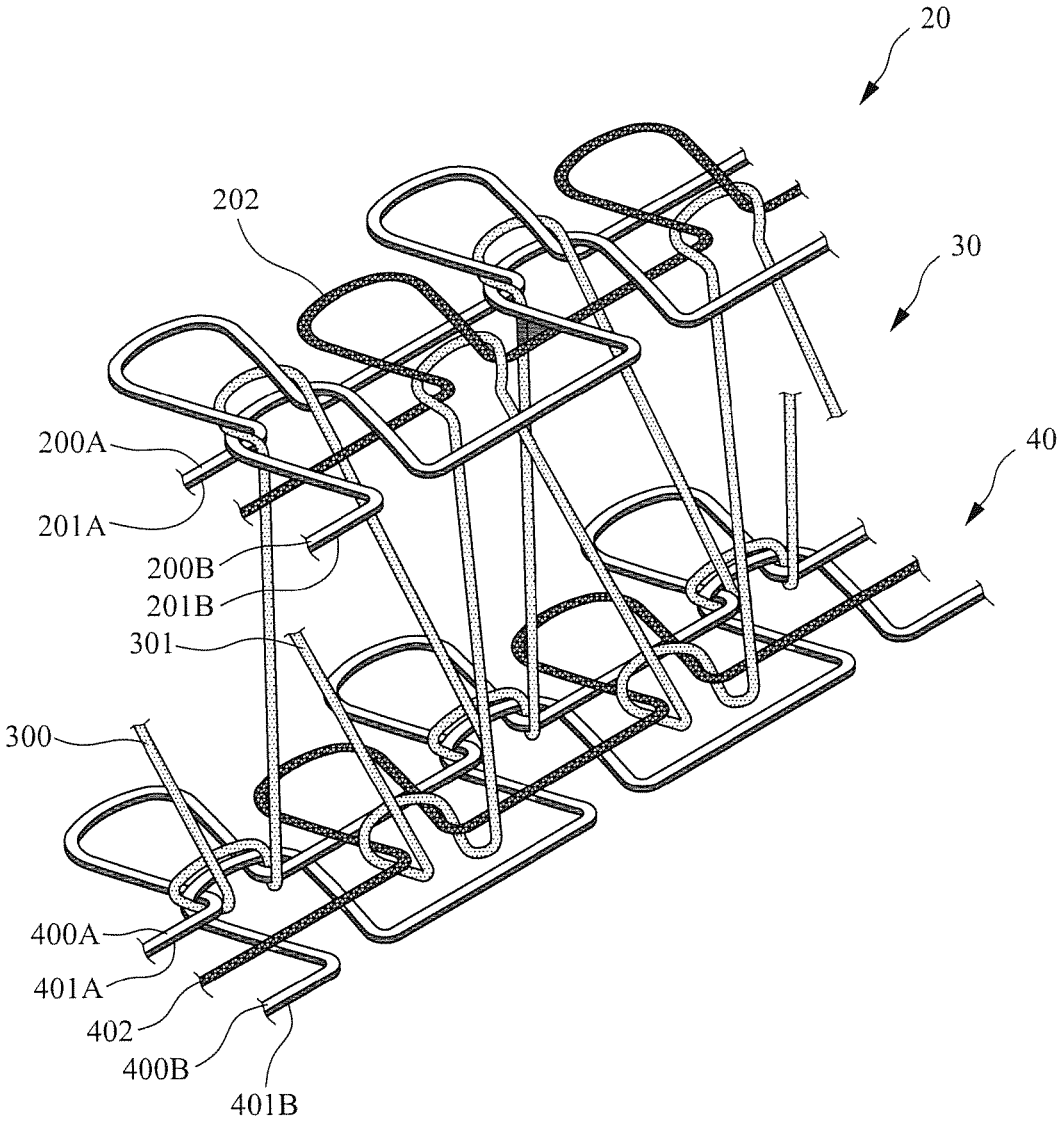
FIG. 3 is a schematic view showing a fabric pressure switch according to the present invention.

With reference to the drawings and in particular to FIG. 3, which is a perspective view showing a fabric pressure switch according to the present invention, as shown in the drawing, in the instant embodiment, the fabric pressure switch according to the present invention comprises a first resilient conductive tissue 20, a support tissue 30, and a second resilient conductive tissue 40, which are knitted unitarily to form the fabric pressure switch with the support tissue 30 arranged between and connecting the resilient conductive tissue 20 and the second resilient conductive tissue 40.

Figure 4:
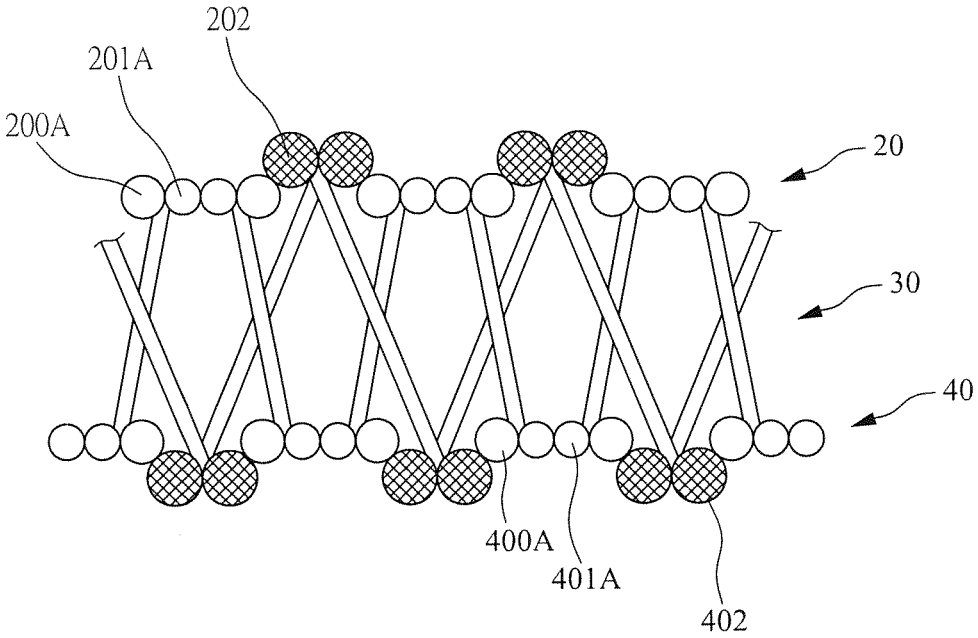
FIG. 4 is a perspective view showing, in an enlarged form, a portion of the fabric pressure switch in accordance with the present invention.

Referring to FIG. 3 and FIG. 4, which is a perspective view showing, in an enlarged form, a portion of the fabric pressure switch in accordance with the present invention, as shown in the drawing, the first resilient conductive tissue 20 is formed by arranging and interlacing a plurality of first structural yarns 200A, a plurality of second structural yarns 200B, a plurality of first elastic yarns 201A, a plurality of second elastic yarns 201B, and a plurality of first electrically conductive yarns 202 along a first dimension and a second dimension, wherein each of the first structural yarns 200A is combined with each of the first elastic yarns 201A as a first strand, each of the second structural yarns 200B is combined with each of the second elastic yarns 201B as a second strand and a plurality of first stitches are formed by individually interlocking each of the first strand and each of the second strand along the second dimension.

The second resilient conductive tissue 40 is formed by arranging and interlacing a plurality of third structural yarns 400A, a plurality of fourth structural yarns 400B, a plurality of third elastic yarns 401A, a plurality of fourth elastic yarns 401B, and a plurality of second electrically conductive yarns 402 along the first dimension and the second dimension, wherein each of the third structural yarns 400A is combined with each of the third elastic yarns 401A as a third strand, each of the fourth structural yarns 400B is combined with each of the fourth elastic yarns 401B as a fourth strand, and a plurality of second stitches are formed by individually interlocking each of the third strand and each of the fourth strand along the second dimension.

The support tissue 30 is formed of a plurality of first support yarns 202 and a plurality of second support yarns 402 and connects between the first resilient conductive tissue 20 and the second resilient conductive tissue 40. Each of the first support yarns 202 is interlocking with the plurality of first stitches of the first resilient conductive tissue 20 along the second dimension and extends to the second resilient conductive tissue 40 along a third dimension to be interlocked with the plurality of second stitches along the second dimension, a plurality of third stitches are formed by individually interlocking each of the second support yarns 402 with each of the first electrically conductive yarns 20 along the second dimension and each of the second support yarns 402 extends to the second resilient conductive tissue 40 along the third dimension to form a plurality of fourth stitches by individually interlocking each of the second support yarns 402 with each of the second electrically conductive yarns 40 along the second dimension. The plurality of first stitches individually space from the plurality of third stitches along the first dimension, the plurality of second stitches individually space from the plurality of fourth stitches along the first dimension. The first electrically conductive yarns 202 project beyond a surface of the first resilient conductive tissue 20 and the second electrically conductive yarns 402 project beyond a surface of the second resilient conductive tissue 40. Furthermore, the first resilient conductive tissue 20 and the second resilient conductive tissue 40 will extrude the support tissue 30 to contact each other when the fabric pressure switch is taken a pressure and the first electrically conductive yarns 202 of the first resilient conductive tissue 20 and the second electrically conductive yarns 402 of the second resilient conductive tissue 40 are separated by the elasticity of the support tissue 30 and formed a broken circuit when the pressure removes from the fabric pressure switch.

Referring to FIG. 4, which is a perspective view showing, in an enlarged form, a portion of the fabric pressure switch in accordance with the present invention, as shown in drawing, the first resilient conductive tissue 20 is formed by arranging and interlacing a plurality of first structural yarns 200A, a plurality of first elastic yarns 201A, a plurality of second structural yarns 200B, a plurality of second elastic yarns 201B and a plurality of first electrically conductive yarns 202 together. Each of the first structural yarns 200A is combined with each of the first elastic yarns 201A as the first strand and each of the second structural yarns 200B is combined with each of the second elastic yarns 201B as the second strand for being arranged alternately with each of the first electrically conductive yarns 202, whereby after the entirety of the fabric pressure switch is completely arranged when the stretching force of yarns are removed, the first elastic yarns 201A get contracting and squeeze the first electrically conductive yarns 202 outward so that the first electrically conductive yarns 202 project beyond the surface of the entire resilient conductive tissue 20. This ensures that when the fabric is placed on human body, the first electrically conductive yarns 202 get contact with the human body first so that the fabric pressure switch according to the present invention may provide improved effect of detection. For the same reason, the second resilient conductive tissue 40 is provided with the same structure and function.

Figure 5:
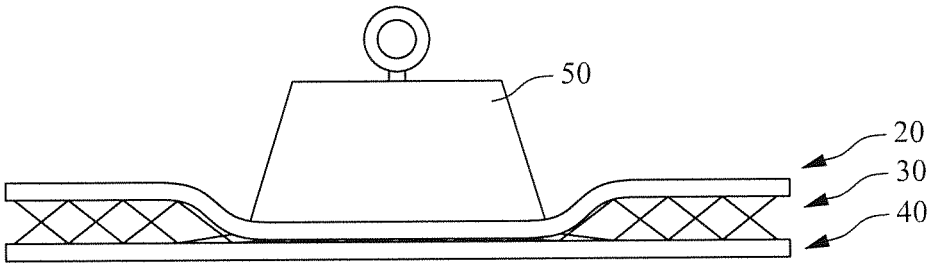
FIG. 5 is a schematic view showing the embodiment of the fabric pressure switch according to the present invention.

Referring to FIG. 5, which is a schematic view showing the embodiment of the fabric pressure switch according to the present invention, as shown in the drawing, when the fabric pressure switch is taken the pressure of a object 50, the first resilient conductive tissue 20 and the second resilient conductive tissue 40 would extrude the support tissue to contact each other. Therefore, a signal receiving and illustrious device (not shown in FIG. 5) electrically connect to the first resilient conductive tissue 20 and the second resilient conductive tissue 40 would detect the pressure in which the fabric pressure switch was taken. Moreover, when the pressure removes from the fabric pressure switch and return to the original condition, as shown in FIG. 3, the first resilient conductive tissue 20 and the second resilient conductive tissue 40 are separated by the elasticity of the support tissue 30 and formed a broken circuit. Therefore, the signal receiving and illustrious device will detect a signal in which the pressure was removed.

The first structural yarns 200A, the second structural yarns 200B, the third structural yarns 400A and the fourth structural yarns 400B can selectively be one of polyester yarn, porous fiber yarn, alginate fiber yarn, carboxymethyl cellulose fiber yarn, rayon fiber yarn, metal fiber yarn, carbon nanotube fiber yarn, and carbon fiber yarn among which porous fiber yarn, alginate fiber yarn, carboxymethyl cellulose fiber yarn, and rayon fiber yarn have the function of moisture retention. If the first structural yarns 200A, the second structural yarns 200B, the third structural yarns 400A and the fourth structural yarns 400B are selected from these four materials, then the fabric pressure switch according to the present invention may shows the characteristics of resiliency, moisture retention, and electrical conductivity.

The first elastic yarns 201A, the second elastic yarns 201B, the third elastic yarns 401A and the fourth elastic yarns 401B can be spandex yarn. The first electrically conductive yarns 202 and the second electrically conductive yarns 402 can selectively be one of metal fiber yarn, carbon nanotube fiber yarn, and carbon fiber yarn. The first support yarns 300 and the second support yarns 301 can selectively be one of polyester yarn and nylon yarn.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A fabric pressure switch, comprising:

a first resilient conductive tissue, which is formed by arranging and interlacing a plurality of first structural yarns, a plurality of second structural yarns, a plurality of first elastic yarns, a plurality of second elastic yarns, and a plurality of first electrically conductive yarns along a first dimension and a second dimension, wherein each of the first structural yarns is combined with each of the first elastic yarns as a first strand, each of the second structural yarns is combined with each of the second elastic yarns as a second strand and a plurality of first stitches are formed by individually interlocking each of the first strand and each of the second strand along the second dimension;

a second resilient conductive tissue, which is formed by arranging and interlacing a plurality of third structural yarns, a plurality of fourth structural yarns, a plurality of third elastic yarns, a plurality of fourth elastic yarns, and a plurality of second electrically conductive yarns along the first dimension and the second dimension, wherein each of the third structural yarns is combined with each of the third elastic yarns as a third strand, each of the fourth structural yarns is combined with each of the fourth elastic yarns as a fourth strand, and a plurality of second stitches are formed by individually interlocking each of the third strand and each of the fourth strand along the second dimension; and a support tissue, which is formed of a plurality of first support yarns and a plurality of second support yarns and connects between the first resilient conductive tissue and the second resilient conductive tissue;

wherein each of the first support yarns is interlocking with the plurality of first stitches of the first resilient conductive tissue along the second dimension and extends to the second resilient conductive tissue along a third dimension to be interlocked with the plurality of second stitches along the second dimension, a plurality of third stitches are formed by individually interlocking each of the second support yarns with each of the first electrically conductive yarns along the second dimension and each of the second support yarns extends to the second resilient conductive tissue along the third dimension to form a plurality of fourth stitches by individually interlocking each of the second support yarns with each of the second electrically conductive yarns along the second dimension;

wherein the plurality of first stitches individually space from the plurality of third stitches along the first dimension, the plurality of second stitches individually space from the plurality of fourth stitches along the first dimension and the first electrically conductive yarns project beyond a surface of the first resilient conductive tissue and the second electrically conductive yarns project beyond a surface of the second resilient conductive tissue;

wherein the first resilient conductive tissue and the second resilient conductive tissue extrude the support tissue to contact each other when the fabric pressure switch is taken a pressure and the first resilient conductive tissue and the second resilient conductive tissue are separated by the elasticity of the support tissue and formed a broken circuit when the pressure removes from the fabric pressure switch.

2. The fabric pressure switch as claimed in claim 1, wherein the first structural yarns, the second structural yarns, the third structural yarns and the fourth structural yarns are each one of polyester yarn, porous fiber yarn, alginate fiber yarn, carboxymethyl cellulose fiber yarn, rayon fiber yarn, metal fiber yarn, carbon nanotube fiber yarn, and carbon fiber yarn.

3. The fabric pressure switch as claimed in claim 1, wherein the first electrically conductive yarns and the second electrically conductive yarns are one of metal fiber yarn, carbon nanotube fiber yarn, and carbon fiber yarn.

4. The fabric pressure switch as claimed in claim 1, wherein the first elastic yarns, the second elastic yarns, the third elastic yarns and the fourth elastic yarns are each spandex yarn.

5. The fabric pressure switch as claimed in claim 1, wherein the first support yarns and the second support yarns are each one of polyester yarn and nylon yarn.

6. The fabric pressure switch as claimed in claim 1, wherein the first structural yarns, the first elastic yarns, the second structural yarns, the second elastic yarns and the first electrically conductive yarns are arranged and interlaced through knitting to form the first resilient conductive tissue.

7. The fabric pressure switch as claimed in claim 1, wherein the third structural yarns, the third elastic yarns, the fourth structural yarns, the fourth elastic yarns and the second electrically conductive yarns are arranged and interlaced through knitting to form the second resilient conductive tissue.

* * * * *